US005114367A

United States Patent [19]

Bolliger

[11] Patent Number: 5,114,367

[45] Date of Patent: May 19, 1992

[54] ELECTRICAL CONNECTION TERMINAL

[75] Inventor: Roman Bolliger, Allschwil, Switzerland

[73] Assignee: Oskar Woertz, Inhaber Hans Woertz, Muttenz, Switzerland

[21] Appl. No.: 717,478

[22] Filed: Jun. 19, 1991

[30] Foreign Application Priority Data

Jul. 24, 1990 [CH] Switzerland ..... 2445/90

[51] Int. Cl.[5] ..... H01R 9/26

[52] U.S. Cl. ..... 434/716; 439/717

[58] Field of Search ..... 439/716, 717, 799, 801, 439/94

[56] References Cited

U.S. PATENT DOCUMENTS 4,907,989 3/1990 Huska ..... 439/716

FOREIGN PATENT DOCUMENTS 1115803 10/1961 Fed. Rep. of Germany ..... 439/717
0479942 1/1954 Italy ..... 439/717
0601258 1/1960 Italy ..... 439/717

*Primary Examiner*—Larry I. Schwartz
*Assistant Examiner*—Hien D. Vu Hdv
*Attorney, Agent, or Firm*—Watson, Cole, Grindle & Watson

[57] ABSTRACT

An electrical connection terminal has a foot with two oppositely directed fingers, the underside of which has a receiving claw and a U-shaped extension with an inwardly open mouth-like recess for engaging the side flanges of a carrier rail, as well as a screw for clamping the recess. The U-shaped extension is wider than the carrier rail, such that the screw passes through externally of the carrier rail. A resiliently deformable element is arranged in the mouth-like recess which at least temporarily holds the terminal fast on the carrier rail.

5 Claims, 1 Drawing Sheet

ELECTRICAL CONNECTION TERMINAL

BACKGROUND OF THE INVENTION

The present invention concerns an electrical connection terminal for snapping on a carrier rail provided with outwardly projecting flanges, wherein the body of the terminal has a foot with two oppositely directed fingers, of which one has a reversely projecting claw and the other has a mouth-like recess formed by a U-shaped extension, and which are provided for engaging the flanges of the carrier rail in the mounted condition, as well as a clamping screw for clamping the mouth-like recess.

In order to enable the terminals to be snapped on carrier rails, the space provided in the foot of the terminal for accommodating the rail must be left open wider than the width of the rail. Preferably, on setting or snapping-on the terminals should adjust by themselves into the correct position for connection (temporary securing).

This has been achieved in known constructions by arranging a metallic spring element in the mouth-like recess of the foot of the terminal, the screw acting directly from above on the spring element to clamp to the flange of the rail.

Such a known terminal is described, e.g., in Swiss Patent No. 532 253.

However, practice has shown that on strongly tightening the screw, the mouth-shaped recess at the terminal foot is deformed, if not actually destroyed. However, a reliable securing of the terminal to the carrier rail thereby becomes questionable.

The object of the present invention was therefore to create an electrical connection terminal of the above-mentioned kind which avoids the described disadvantages and which assures a reliable connection between the terminal and the carrier rail.

SUMMARY OF THE INVENTION

This object is solved according to the invention in an electrical connection terminal of the above-mentioned type in such a manner that the foot of the terminal with the U-shaped extension having the mouth-like recess is so much broader than the carrier rail with its side flanges that when the terminal is set on the carrier rail the screw is guided externally of the rail flange through a bore in the upper shank, the recess and a threaded bore in the lower shank of the U-shaped extension and that a resiliently deformable element is arranged in the mouth-like recess which, when the terminal is set on a carrier rail, is resiliently compressed by an external force effect by the rail flange and then presses the terminal away until the carrier rail comes to lie in the desired position in the oppositely lying claw opening.

The result of the above is that the automatic adjustment into the position correct for connection ensues by way of the resilient element inserted into the foot of the terminal.

For mounting, the side of the foot of the terminal of the resilient element is set on one of the flanges of the carrier rail and pressure is exerted on the terminal. The other side of the foot of the terminal is formed as a claw which must overcome the oppositely lying flange of the rail. Through the external pressure the claw overcomes the flange and thereby forces the resilient element back. After overcoming the flange the resilient element returns to its original shape and thus brings the terminal to the position correct for connection. Then for the final rigid clamping the screw is to be tightened, whereby here both shanks of the U-shaped extension bear against the flange of the carrier rail.

Preferably, the resilient deformable element has a recess through which the screw is guided, preferably with lateral play.

In a particularly advantageous preferred embodiment the resiliently deformable element is formed as a bolt and is provided at its outer end with an additional resilient extension which may have the shape of a slitted hollow cylinder.

The resiliently deformable element consists of an elastomeric material, particularly of rubber.

The invention is described below in somewhat greater detail by way of a preferred embodiment illustrated in the drawing;

DETAILED DESCRIPTION OF THE PREFERRED EMBODIMENT

Figure 1:
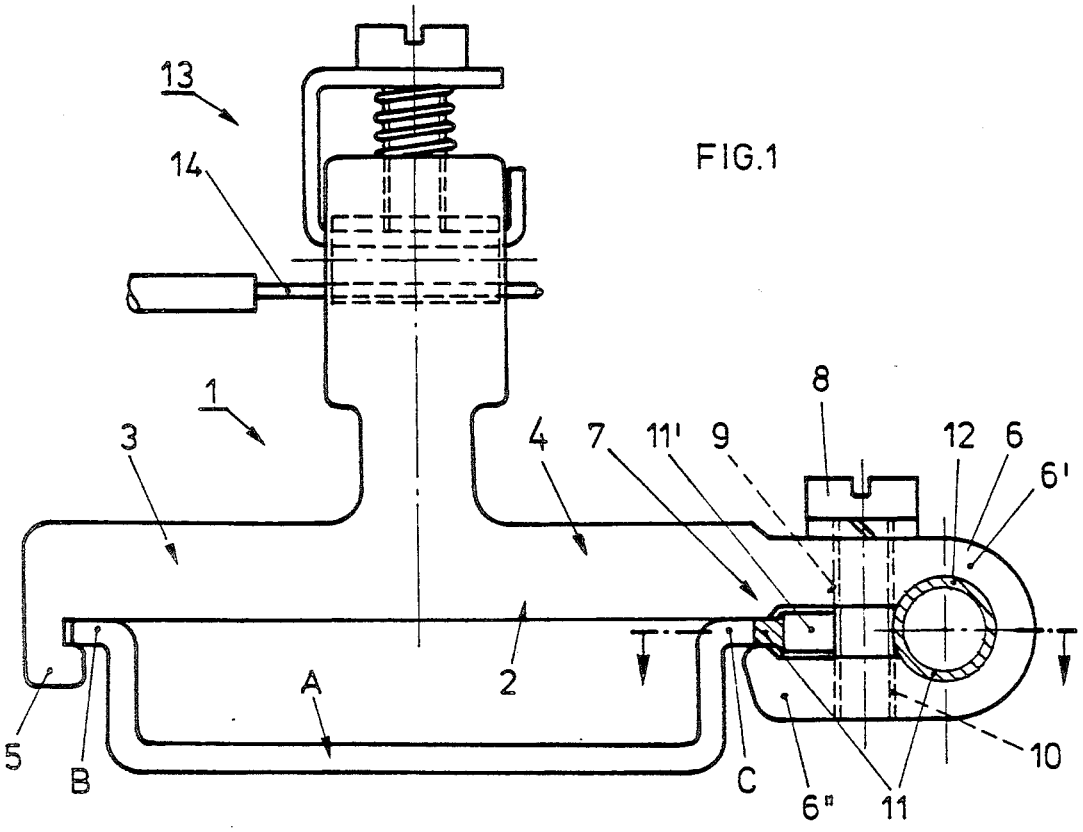
FIG. 1 is a side view of a connecting terminal according to the invention.
Figure 2:
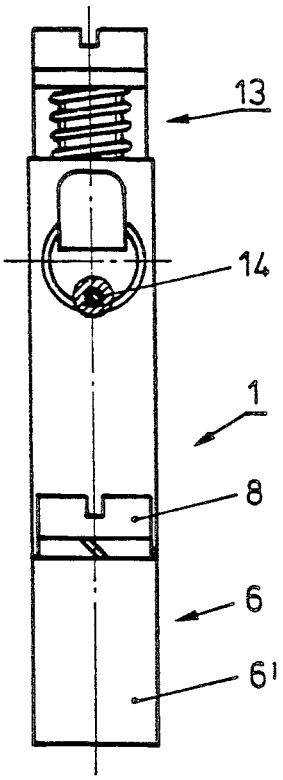
FIG. 2 is a side view of the terminal of FIG. 1.
Figure 3:
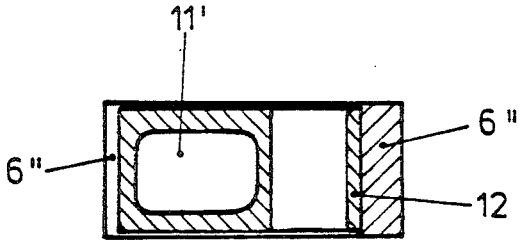
FIG. 3 is a section through the foot of the terminal along the line III—III.

The electrical connection terminal 1 shown in the drawing is provided for being snapped on a carrier rail A with oppositely projecting side flanges B, C.

At its head the terminal body 1 has a device 13 for rigidly clamping an electrical conductor 14, the device 13 being conventional, i.e., known to the person skilled in the art. This part of the terminal is not the object of the invention.

Furthermore, the terminal body 1 has a foot 2 with two oppositely directed fingers 3, 4, of which one has a reversely projecting claw 5 on its underside and the other has an inwardly open mouth-like recess 7 formed by a U-shaped extension 6. In the mounted position the claw and the recess serve to engage the flanges B, C of the carrier rail. A screw 8 is furthermore provided for rigidly clamping the mouth-like recess 7.

As is clear from the drawing, the foot 2 of the terminal with the extension 6 forming the mouth-like recess 7 is wider than the carrier rail A with its side flanges B, C by an amount such that when a terminal 1 is mounted on the profiled rail A the screw 8 is passed externally of the flange C of the rail through a bore 9 in the upper limb 6' of the extension and through the opening 7 into a threaded bore 10 in the lower limb 6'' of the extension. This makes it possible for the two limbs 6', 6'', of the extension to be clamped together by way of the screw 8 and thereby rigidly to secure one of the carrier rail flanges C.

A bolt-like element 11 of resiliently deformable material (plastics, rubber) is arranged in the mouth-like recess 7. At its outer end the element 11 has a springy extension 12 which in the illustrated example has the shape of a slitted hollow cylinder.

One proceeds as follows to mount the terminal 1 of the carrier rail A. The side of the foot 2 of the terminal with the extension 6 having the recess 7 and with the resiliently deformable element 11 arranged in the recess 7 is mounted on flange C of the carrier rail A and pressure is exerted thereby on the terminal 1. In this way the claw 5 is snapped over the oppositely lying side of the foot 2 over the flange B of the carrier rail A, this occurring under compression of the resiliently deformable element 11. After snapping-in the element 11 returns to its original form and thereby brings the terminal automatically to the correct position for connection. Now one only needs to tighten the screw 8 in order rigidly to fix the terminal on the carrier rail flange C.

The screw 8 is passed through an elongated cavity 11' in the element 11 so that the latter may be freely displaced relatively to the screw 8 (at least, as long as the screw 8 is not tightened).

Thanks to the construction of the terminal 1 according to the invention, a reliable connection between the terminal 1 and the carrier rail A is always assured.

I claim:

1. An electrical connection terminal for snapping on a carrier rail having outwardly projecting flanges, wherein the terminal body has a foot with two oppositely directed fingers of which one has a reversely projecting claw on its underside and the other has a mouth-like recess formed by a U-shaped extension, which fingers are provided for engaging the flanges of the carrier rail in the mounted position, as well as a screw for securing to the mouth-like recess, wherein the foot of the terminal with the U-shaped extension having the mouth-like recess being formed so much wider than the carrier rail with its side flanges that when the terminal is mounted on the carrier rail the screw passes externally of the rail flange through a bore in the upper limb and the recess into a threaded bore in the lower limb of the U-shaped extension, and a resiliently deformable element is arranged in the mouth-like recess which on mounting the terminal on a carrier rail is resiliently compressed by the rail flange through an external force effect and then pushes the terminal away until the carrier rail lies in the desired position in the oppositely lying opening of the claw.

2. A connection terminal according to claim 1, wherein the resiliently deformable element has a recess through which the clamping screw passes through, preferably with lateral play.

3. A connection terminal according to claim 1, wherein the resiliently deformable element is formed as a bolt and is provided at its outer end with an additional springy extension.

4. A connection terminal according to claim 3, wherein the springy extension has the form of a slitted hollow cylinder.

5. A connection terminal according to claim 1, wherein the resiliently deformable element consists of an elastomeric material.

* * * * *